US008405296B2

(12) United States Patent
Shimamura et al.

(10) Patent No.: US 8,405,296 B2
(45) Date of Patent: Mar. 26, 2013

(54) PLASMA DISPLAY PANEL

(75) Inventors: Takayuki Shimamura, Osaka (JP); Jun Hashimoto, Osaka (JP); Takuji Tsujita, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/202,585

(22) PCT Filed: Mar. 15, 2011

(86) PCT No.: PCT/JP2011/001485

§ 371 (c)(1), (2), (4) Date: Aug. 22, 2011

(87) PCT Pub. No.: WO2011/114697

PCT Pub. Date: Sep. 22, 2011

(65) Prior Publication Data

US 2012/0326595 A1 Dec. 27, 2012

(30) Foreign Application Priority Data

Mar. 15, 2010 (JP) ..... 2010-057046

(51) Int. Cl.
*H01J 1/62* (2006.01)

(52) U.S. Cl. ..... 313/489; 313/582; 313/587

(58) Field of Classification Search ..... 313/489, 313/582, 587

See application file for complete search history.

(56) References Cited

U.S. PATENT DOCUMENTS

| | | | |
|---|---|---|---|
| 6,242,864 B1 | 6/2001 | Nakahara et al. | |
| 7,626,336 B2 | 12/2009 | Hai et al. | |
| 2002/0121861 A1 | 9/2002 | Katou et al. | |
| 2006/0220557 A1 | 10/2006 | Sugawa et al. | |
| 2007/0262715 A1 | 11/2007 | Yan et al. | |
| 2010/0327742 A1 * | 12/2010 | Hashimoto et al. | 313/587 |

FOREIGN PATENT DOCUMENTS

| | | | |
|---|---|---|---|
| JP | 08-236028 A | | 9/1996 |
| JP | 10-334809 A | | 12/1998 |
| JP | 11-339665 A | | 12/1999 |
| JP | 2002-260535 A | | 9/2002 |
| JP | 2003-173738 A | | 6/2003 |
| JP | 2004241309 | * | 8/2004 |
| JP | 2005264272 A2 | * | 4/2005 |
| JP | 2006-059779 A | | 3/2006 |
| JP | 2006-286324 A | | 10/2006 |
| JP | 2007-323922 A | | 12/2007 |
| JP | 2008-091074 A | | 4/2008 |
| JP | 2009-537063 A | | 10/2009 |
| WO | WO 2007/133698 A2 | | 11/2007 |

OTHER PUBLICATIONS

Japanese Search Report for Application No. PCT/JP2011/001485 (with/English translation of Form PCT/ISA/210), May 17, 2011, Panasonic Corporation.

* cited by examiner

*Primary Examiner* — Anh Mai
*Assistant Examiner* — Brenitra M Lee
(74) *Attorney, Agent, or Firm* — RatnerPrestia

(57) ABSTRACT

PDP (1) includes front plate (2) and rear plate (10). Front plate (2) has protective layer (9). Rear plate (10) has phosphor layers (15). Protective layer (9) includes protective layer magnesium oxide and calcium oxide, and exhibits three peaks in a range from not less than 340 eV to not greater than 355 eV of a binding energy spectrum in a binding energy analysis of protective layer (9) by X-ray photoemission spectroscopy.

1 Claim, 7 Drawing Sheets

PLASMA DISPLAY PANEL

This application is a U.S. National Phase Application of PCT International Application PCT/JP2011/001485.

TECHNICAL FIELD

The technology disclosed herein relates to plasma display panels for used in display devices and the like.

BACKGROUND ART

A plasma display panel (hereinafter, referred to as "PDP") is composed of a front plate and a rear plate. The front plate includes: a glass substrate; display electrodes formed on one of the main surfaces of the glass substrate; a dielectric layer covering the display electrodes, which serves as a capacitor; and a protective layer formed on the dielectric layer, which is composed of magnesium oxide (MgO). On the other hand, the rear plate includes: a glass substrate; data electrodes formed on one of the main surfaces of the glass substrate; an underlying dielectric layer covering the data electrodes; barrier ribs formed on the underlying dielectric layer; and phosphor layers formed between the barrier ribs, which each emit light of red, green, or blue.

The front plate and rear plate are hermetically sealed, with their electrode-formed-surface sides being opposed to one another. In discharge spaces which are partitioned by the barrier ribs, a discharge gas containing neon (Ne) and xenon (Xe) is enclosed. The discharge gas produces discharges by video signal voltages which are selectively applied to the display electrodes. The discharges generate ultraviolet rays which excite each of the phosphor layers. Each of the excited phosphor layers emits light of red, green, or blue. Thus, the PDP provides displays of color images (see, Patent Literature 1).

The protective layer has four major functions: the first is to protect the dielectric layer from ion bombardment caused by the discharges; the second is to emit initial-electrons for generating data discharges; the third is to retain charges for generating the discharges; and the fourth is to emit secondary-electrons during sustain discharges. The protection of the dielectric layer from ion bombardment can inhibit an increase in discharge voltage. An increase in the number of emitted initial-electrons can reduce data-misdischarges that may cause flicker of an image. An improvement of charge-retention performance can make applied voltages be reduced. An increase in the number of emitted secondary-electrons can make a sustain discharge voltage be reduced. In order to increase the number of emitted initial-electrons, attempts have been made which include, for example, an addition of silicon (Si) and/or aluminum (Al) to MgO of a protective layer (see Patent Literatures 1, 2, 3, 4, and 5, for example).

CITATION LIST

Patent Literature

Patent Literature 1: Japanese Patent Unexamined Publication No. 2002-260535

Patent Literature 2: Japanese Patent Unexamined Publication No. H11-339665

Patent Literature 3: Japanese Patent Unexamined Publication No. 2006-59779

Patent Literature 4: Japanese Patent Unexamined Publication No. H08-236028

Patent Literature 5: Japanese Patent Unexamined Publication No. H10-334809

SUMMARY OF THE INVENTION

A PDP includes a front plate and a rear plate disposed opposite to the front plate. The front plate has a dielectric layer and a protective layer covering the dielectric layer. The rear plate has an underlying dielectric layer, a plurality of barrier ribs formed on the underlying dielectric layer, and phosphor layers formed on the underlying dielectric layer and on the side surfaces of the barrier ribs. The protective layer includes a base layer formed on the dielectric layer. The base layer is such that aggregated particles, in which a plurality of crystal particles of magnesium oxide are aggregated, are dispersed and disposed on the entire surface of the layer. The base layer includes at least a first metal oxide and a second metal oxide. Moreover, the base layer exhibits at least one peak in X-ray diffraction analysis. The peak lies between a first peak of the first metal oxide in X-ray diffraction analysis and a second peak of the second metal oxide in X-ray diffraction analysis. The first peak and the second peak show the same plane direction as that which the peak of the base layer shows. The first metal oxide and the second metal oxide are two selected from the group consisting of magnesium oxide, calcium oxide, strontium oxide, and barium oxide. The phosphor layer includes particles of the platinum group elements.

DESCRIPTION OF EMBODIMENTS

A PDP according to an embodiment will be described hereinafter.

Figure 1:
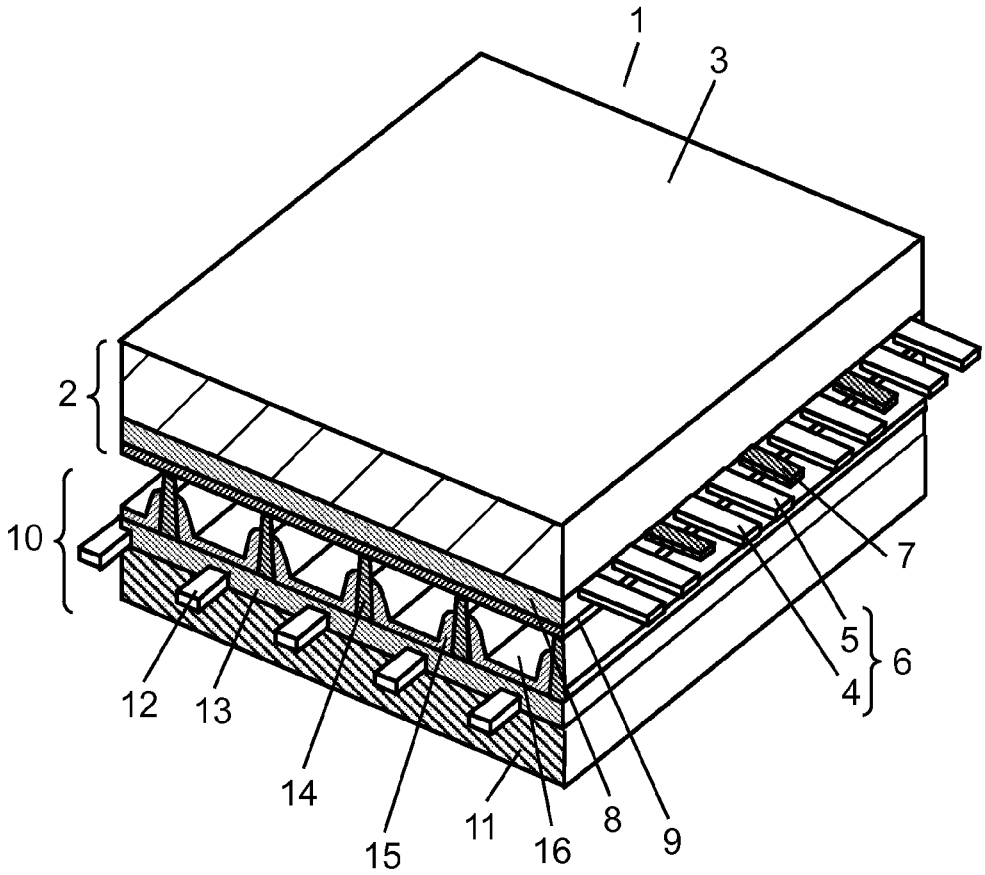
FIG. 1 is a perspective view illustrating a structure of a PDP according to an embodiment.

The basic structure of the PDP is a typical one of alternating-current surface discharge PDPs. As shown in FIG. 1, PDP 1 includes: front plate 2 composed of such as front glass substrate 3; and rear plate 10 composed of such as rear glass substrate 11, with both the plates being disposed opposite to one another. Front plate 2 and rear plate 10 are hermetically sealed at outer peripheries thereof with a sealing material composed of such as glass frit. In discharge spaces 16 inside sealed PDP 1, a discharge gas containing Ne and Xe is enclosed at a pressure of 53 kPa (400 Torr) to 80 kPa (600 Torr).

On front glass substrate 3, a plurality of strip-shaped display electrodes 6 and a plurality of black stripes 7 are arranged in parallel with each other. Display electrodes 6 are each composed of a pair of scan electrode 4 and sustain electrode 5. On front glass substrate 3, dielectric layer 8 serving as a capacitor is formed to cover display electrodes 6 and black stripes 7. Moreover, on the surface of dielectric layer 8, protective layer 9 composed of such as MgO is formed.

Scan electrode 4 and sustain electrode 5 are each formed such that a bus electrode containing Ag is laminated on a transparent electrode composed of a conductive metal oxide including indium tin oxide (ITO), tin dioxide ($SnO_2$), and zinc oxide (ZnO).

On rear glass substrate 11, a plurality of data electrodes 12 are arranged in parallel with each other in a direction perpendicular to display electrodes 6 and are composed of a conductive material containing silver (Ag) as a major component. Data electrodes 12 are covered with underlying dielectric layer 13. In addition, on underlying dielectric layer 13 between data electrodes 12, barrier ribs 14 with a predetermined height are formed so as to partition discharge spaces 16. On underlying dielectric layer 13 and the side surfaces of barrier ribs 14, phosphor layers 15 are sequentially formed by printing in this order for every data electrode 12. Each of phosphor layers 15 emits light of red, green, or blue by ultraviolet rays. Discharge cells are each formed at a position where display electrode 6 intersects with data electrode 12. Discharge cells, each of which has phosphor layer 15 of red, green, or blue arranged in a direction of display electrodes 6, are to serve as pixels for color display.

Note that, in the embodiment, the discharge gas enclosed in discharge spaces 16 contains Xe in a range from not less than 10 vol % to not greater than 30 vol %.

Next, a description of a method for manufacturing PDP 1 will be given.

First, a method for manufacturing front plate 2 is described. Scan electrodes 4, sustain electrodes 5, and black stripes 7 are formed on front glass substrate 3 by photolithography. Scan electrodes 4 and sustain electrodes 5 have bus electrodes 4*b* and 5B, respectively, containing Ag that provides electric conductivity. In addition, scan electrodes 4 and sustain electrodes 5 have transparent electrodes 4*a* and 5*a*, respectively. Bus electrodes 4*b* are laminated on transparent electrodes 4*a*; bus electrodes 5*b* are laminated on transparent electrodes 5*a*.

For a material of transparent electrodes 4*a* and 5*a*, ITO or the like is used so as to provide transparency and electric conductivity for the electrodes. First, an ITO thin film is formed on front glass substrate 3 by sputtering or the like. Then, transparent electrodes 4*a* and 5*a* are formed into a predetermined pattern by lithography.

For a material of bus electrodes 4*b* and 5*b*, a white paste is used which includes Ag, glass frit for mutually binding Ag, photosensitive resins, solvents, and the like. First, the white paste is applied on front glass substrate 3 by screen printing or the like. Next, the solvents in the white paste are removed with a drying furnace. Then, the white paste is exposed via a photomask of a predetermined pattern.

Next, the white paste is developed to form a pattern of the bus electrodes. Finally, the paste with the pattern of the bus electrodes is fired at a predetermined temperature with a firing furnace; that is, the photosensitive resins in the pattern of the bus electrodes are removed, and the glass frit in the pattern of the bus electrodes is melted. The melted glass frit is vitrified again after the firing. With the above processes, bus electrodes 4*b* and 5*b* are formed.

Black stripes 7 are formed using a material including a black pigment. Next, dielectric layer 8 is formed. For a material of dielectric layer 8, a dielectric paste is used which includes dielectric glass frit, resins, solvents, and the like. First, the dielectric paste is applied by die coating or the like with a predetermined thickness on front glass substrate 3 so as to cover scan electrodes 4, sustain electrodes 5, and black stripes 7. Next, the solvents in the dielectric paste are removed with a drying furnace. Finally, the dielectric paste is fired at a predetermined temperature with a firing furnace; that is, the resins in the dielectric paste are removed, and the dielectric glass frit is melted. The melted glass frit is vitrified again after the firing. With the above processes, dielectric layer 8 is completed. Here, instead of die coating, the dielectric paste may be applied by screen printing, spin coating, or the like. Moreover, instead of the use of the dielectric paste, a film to be dielectric layer 8 may be formed by CVD (Chemical Vapor Deposition) or the like. Details of dielectric layer 8 will be given later.

Next, protective layer 9 is formed on dielectric layer 8. Details of protective layer 9 will be described later.

With the above processes, scan electrodes 4, sustain electrodes 5, black stripes 7, dielectric layer 8, and protective layer 9 are formed on front glass substrate 3, thus completing front plate 2.

Next, a method for manufacturing rear plate 10 is described. Data electrodes 12 are formed on rear glass substrate 11 by photolithography. For a material of data electrodes 12, a data electrode paste is used which includes Ag for providing electric conductivity, glass frit for mutually binding Ag, photosensitive resins, solvents, and the like. First, the data electrode paste is applied, by screen printing or the like, with a predetermined thickness on rear glass substrate 11. Then, the solvents in the data electrode paste are removed with a drying furnace. Next, the data electrode paste is exposed via a photomask of a predetermined pattern. Next, the data electrode paste is developed to form a pattern of the data electrodes. Finally, the paste with the pattern of the data electrodes is fired at a predetermined temperature with a firing furnace; that is, the photosensitive resins in the pattern of the data electrodes are removed, and the glass frit in the pattern of the data electrodes is melted. The melted glass frit is vitrified again after the firing. With the above processes, data electrodes 12 are completed. Here, instead of screen printing of the data electrode paste, other methods including sputtering and vapor deposition may be used.

Next, underlying dielectric layer 13 is formed. For a material of underlying dielectric layer 13, an underlying dielectric layer paste is used which includes dielectric glass frit, photosensitive resins, solvents, and the like. First, the underlying dielectric layer paste is applied, by screen printing or the like, with a predetermined thickness on rear glass substrate 11 on which data electrodes 12 have been formed. The applied paste covers data electrodes 12. Then, the solvents in the underlying dielectric layer paste are removed with a drying furnace. Finally, the underlying dielectric layer paste is fired at a predetermined temperature with a firing furnace; that is, the resins in the underlying dielectric layer paste are removed, and the dielectric glass frit is melted. The melted glass frit is vitrified again after the firing. With the above processes, underlying dielectric layer 13 is completed. Here, instead of screen printing, the underlying dielectric layer paste may be applied by die coating, spin coating, or the like. Moreover, instead of the use of the underlying dielectric layer paste, a film to be underlying dielectric layer 13 may be formed by CVD (Chemical Vapor Deposition) or the like.

Next, barrier ribs 14 are formed by photolithography. For a material of barrier ribs 14, a barrier rib paste is used which includes filler, glass frit for binding the filler, photosensitive resins, solvents, and the like. First, the barrier rib paste is applied, by die coating or the like, with a predetermined thickness on underlying dielectric layer 13. Then, the solvents in the barrier rib paste are removed with a drying furnace. Next, the barrier rib paste is exposed via a photomask of a predetermined pattern. Then, the barrier rib paste is developed to form a pattern of the barrier ribs. Finally, the pattern of the barrier ribs is fired at a predetermined temperature with a firing furnace; that is, the photosensitive resins in the pattern of the barrier ribs are removed, and glass frit in the pattern of the barrier ribs is melted. The melted glass frit is vitrified again after the firing. With the above processes, barrier ribs 14 are completed. Here, instead of photolithography, other methods including sandblasting may be used.

Next, phosphor layers 15 are formed. For materials of phosphor layers 15, phosphor pastes 19 are used which each include phosphor particles 17, binders, solvents, and the like. Moreover, in the embodiment, particles of the platinum group elements are included in phosphor pastes 19. First, phosphor pastes 19 are applied, by dispenser-coating or the like, with a predetermined thickness on underlying dielectric layer 13 located between adjacent barrier ribs 14 and on the side surfaces of barrier ribs. Then, the solvents in phosphor pastes 19 are removed with a drying furnace. Finally, phosphor pastes 19 are fired at a predetermined temperature with a firing furnace; that is, the resins in phosphor pastes 19 are removed. With the above processes, phosphor layers 15 are completed. Here, instead of dispenser-coating, other methods including screen printing and ink-jetting may be used. Details of phosphor layers 15 will be described later.

With the above processes, rear plate 10 having predetermined components on rear glass substrate 11 is completed.

Next, front plate 2 and rear plate 10 are assembled. First, a sealing material (not shown) is formed on the periphery of rear plate 10 by dispenser-coating or the like. For a material of the sealing material (not shown), a sealing paste is used which includes glass frit, binders, solvents, and the like. Then, the solvents in the sealing paste are removed with a drying furnace. Next, front plate 2 and rear plate 10 are disposed opposite to one another such that display electrodes 6 intersect at right angle with data electrodes 12. Then, front plate 2 and rear plate 10 are sealed at the peripheries thereof with the glass frit. Finally, a discharge gas containing Ne and Xe is enclosed in discharge spaces 16, thus completing PDP 1.

Figure 2:
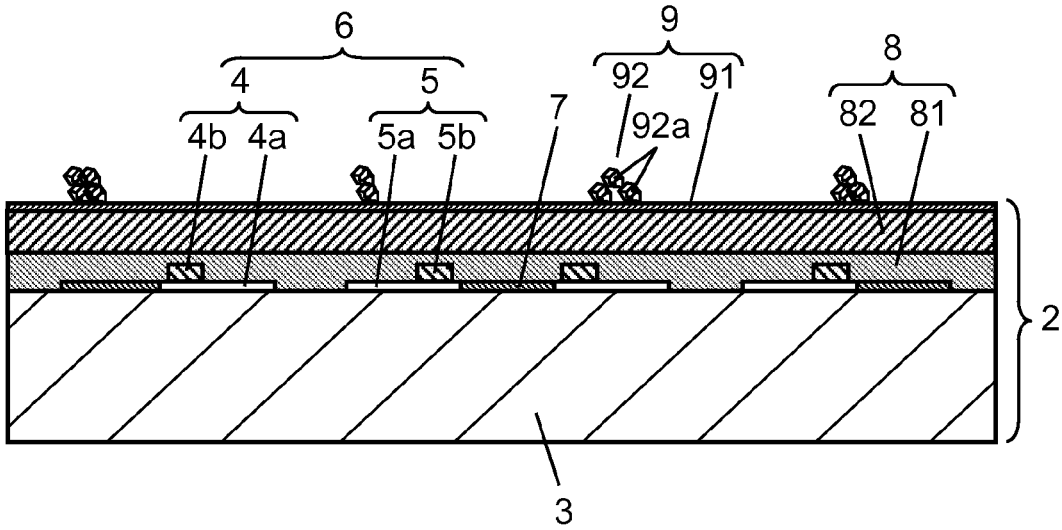
FIG. 2 is a cross-sectional view illustrating a configuration of a front plate of the PDP.

Now, details of a configuration of the embodiment will be described. As shown in FIG. 2, on front glass substrate 3, a plurality of strip-shaped display electrodes 6 and a plurality of black stripes 7 are arranged in parallel with each other. Display electrodes 6 are each composed of a pair of scan electrode 4 and sustain electrode 5. On front glass substrate 3, dielectric layer 8 is formed to cover display electrodes 6 and black stripes 7. Moreover, on the surface of dielectric layer 8, protective layer 9 is formed. Protective layer 9 includes base layer 91 laminated on dielectric layer 8, and aggregated particles 92 adhering on base layer 91.

Figure 10:
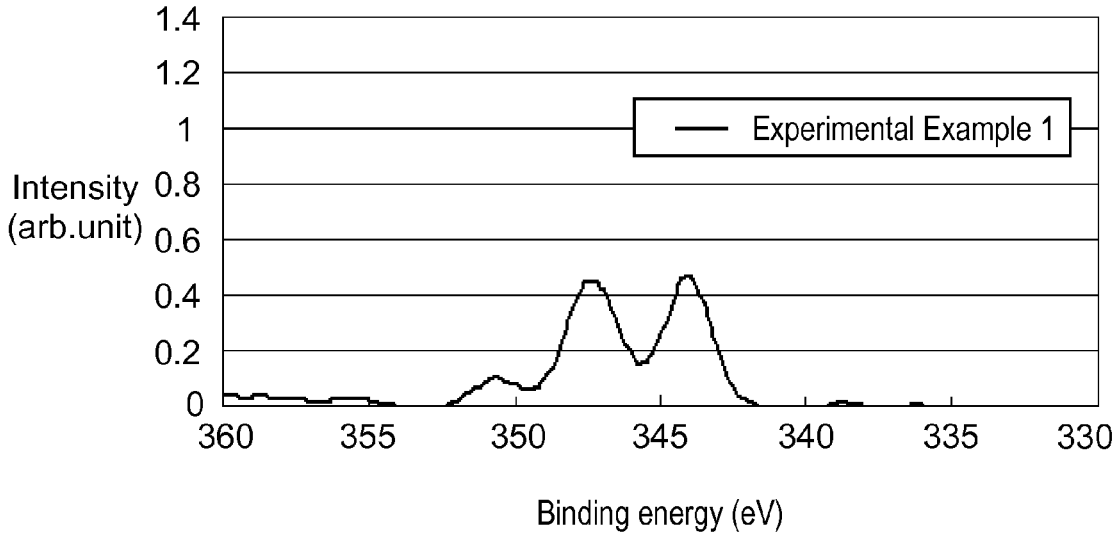
FIG. 10 shows a biding energy spectrum by X-ray photoemission spectroscopy of a protective layer of a PDP according to a first embodiment.

Moreover, on rear glass substrate 11, a plurality of data electrodes 12 are disposed in parallel with one another in a direction perpendicular to display electrodes 6, as shown in FIG. 10 to be described later. Data electrodes 12 are covered with underlying dielectric layer 13. Furthermore, barrier ribs 14 are formed on underlying dielectric layer 13 between data electrodes 12. Phosphor layers 15 are formed on underlying dielectric layer 13 and on the side surfaces of barrier ribs 14. On phosphor layers 15, platinum-group-element particles 18, i.e. particles of the platinum group elements, are attached to adhere.

Now, details of dielectric layer 8 are described. Dielectric layer 8 is configured with first dielectric layer 81 and second dielectric layer 82. Second dielectric layer 82 is laminated on first dielectric layer 81.

A dielectric material of first dielectric layer 81 includes the following components: 20 wt % to 40 wt % of bismuth(III) oxide ($Bi_2O_3$); 0.5 wt % to 12 wt % of at least one of the group consisting of calcium oxide (CaO), strontium oxide (SrO), and barium oxide (BaO); and 0.1 wt % to 7 wt % of at least one of the group consisting of molybdenum trioxide ($MoO_3$), tungsten trioxide ($WO_3$), cerium dioxide ($CeO_2$), and manganese dioxide ($MnO_2$).

Note that, instead of the group consisting of $MoO_3$, $WO_3$, $CeO_2$, and $MnO_2$, the dielectric material may include 0.1 wt % to 7 wt % of at least one of the group consisting of copper oxide (CuO), chromium(III) oxide ($Cr_2O_3$), cobalt(III) oxide ($Co_2O_3$), divanadium heptaoxide ($V_2O_7$), and diantimony trioxide ($Sb_2O_3$).

Moreover, in addition to the above components, the dielectric material may include lead-free components including such as: zero to 40 wt % of zinc oxide (ZnO); zero to 35 wt % of diboron trioxide ($B_2O_3$); zero to 15 wt % of silicon dioxide ($SiO_2$); and zero to 10 wt % of aluminum(III) oxide ($Al_2O_3$).

The dielectric material is grinded to produce a dielectric material powder by wet jet-milling, ball milling, or the like, such that an average particle diameter thereof is 0.5 μm to 2.5 μm. Next, 55 wt % to 70 wt % of the dielectric material powder and 30 wt % to 45 wt % of a binder component are thoroughly kneaded with a three-roll mill to produce a paste for the first dielectric layer. The resulting paste is applicable for die-coating or printing application.

The binder component is ethylcellulose, terpineol containing 1 wt % to 20 wt % of acrylic resins, or butyl carbitol acetate. Moreover, as a plasticizing agent, dioctyl phthalate, dibutyl phthalate, triphenyl phosphate, and tributyl phosphate may be added to the paste, if necessary. In addition, dispersing agents may be added, including such as glycerol monooleate, sorbitan sesquioleate, Homogenol (trade name, manufactured by Kao Corporation), and alkylallyl phosphate ester. The addition of the dispersing agents improves printability of the paste.

The paste for the first dielectric layer is printed, by die coating or screen printing, on front glass substrate 3 so as to cover display electrodes 6. After drying, the printed paste for the first dielectric layer is fired at a temperature of 575° C. to 590° C. that is slightly higher than the softening point of the dielectric material, thus completing first dielectric layer 81.

Next, a description of second dielectric layer 82 is made. A dielectric material of second dielectric layer 82 includes the following components: 11 wt % to 20 wt % of $Bi_2O_3$; 1.6 wt % to 21 wt % of at least one selected from CaO, SrO, and BaO; and 0.1 wt % to 7 wt % of at least one selected from $MoO_3$, $WO_3$, and $CeO_2$.

Note that, instead of $MoO_3$, $WO_3$, and $CeO_2$, the dielectric material may include 0.1 wt % to 7 wt % of at least one selected from CuO, $Cr_2O_3$, $Co_2O_3$, $V_2O_7$, $Sb_2O_3$, and $MnO_2$.

Moreover, in addition to the above components, the dielectric material may include lead-free components including such as: zero to 40 wt % of ZnO; zero to 35 wt % of $B_2O_3$; zero to 15 wt % of $SiO_2$; and zero to 10 wt % of $Al_2O_3$.

The dielectric material is grinded to produce a dielectric material powder by wet jet-milling, ball milling, or the like, such that an average particle diameter thereof is 0.5 μm to 2.5 μm. Next, 55 wt % to 70 wt % of the dielectric material powder and 30 wt % to 45 wt % of a binder component are thoroughly kneaded with a three-roll mill to produce a paste for the second dielectric layer. The resulting paste is applicable for die-coating or printing application.

The binder component is ethylcellulose, terpineol containing 1 wt % to 20 wt % of acrylic resins, or butyl carbitol acetate. Moreover, as a plasticizing agent, dioctyl phthalate, dibutyl phthalate, triphenyl phosphate, and tributyl phosphate may be added to the paste, if necessary. In addition, dispersing agents may be added, including such as glycerol monooleate, sorbitan sesquioleate, Homogenol (trade name, manufactured by Kao Corporation), and alkylallyl phosphate ester. The addition of the dispersing agents improves printability of the paste.

The paste for the second dielectric layer is printed, by screen printing or die coating, on first dielectric layer 81. After drying, the printed paste for the second dielectric layer is fired at a temperature of 550° C. to 590° C. that is slightly higher than the softening point of the dielectric material, thus completing second dielectric layer 82.

Note that, in order to provide a high visible light transmittance, the cumulated thickness of first dielectric layer 81 and second dielectric layer 82 is preferably made to be 41 μm or less.

In order to inhibit a reaction of Ag with bus electrodes 4*b* and 5*b*, first dielectric layer 81 is made such that a content ratio of $Bi_2O_3$ thereof is 20 wt % to 40 wt %, which is larger than that of $Bi_2O_3$ of second dielectric layer 82. This results in a lower visible light transmittance of first dielectric layer 81 than that of second dielectric layer 82; therefore, the thickness of first dielectric layer 81 is made to be thinner than that of second dielectric layer 82.

Second dielectric layer 82 is hard to undergo coloration when the content ratio of $Bi_2O_3$ thereof is 11 wt % or less; however, it makes second dielectric layer 82 tend to generate bubbles therein. Therefore, it is not preferable that the content ratio of $Bi_2O_3$ be 11 wt % or less. On the other hand, the layer tends to undergo coloration when the content ratio of $Bi_2O_3$ thereof is 40 wt % or more, which results in a decreased visible light transmittance thereof. Therefore, it is not preferable that the content ratio of $Bi_2O_3$ exceed 40 wt %.

Moreover, the thinner the thickness of dielectric layer 8 is, the more remarkable the advantage of increasing luminance and reducing a discharge voltage is. Hence, the thickness of the layer is set preferably as small as possible within a range in which an isolation voltage thereof does not decrease.

From the above viewpoint, in the embodiment, the thickness of dielectric layer 8 is set to 41 μm or less, the thickness of first dielectric layer 81 is set to 5 μm to 15 μm, and the thickness of second dielectric layer 82 is set to 20 μm to 36 μm.

Thus produced PDP 1 is confirmed to have dielectric layer 8 of excellent isolation-voltage performance. That is, coloration phenomenon (yellowing) of front glass substrate 3, bubble formation in dielectric layer 8, and the like are inhibited even when the Ag material is used in display electrodes 6.

Next, in PDP 1 according to the embodiment, the reason why these dielectric materials can inhibit occurrences of yellowing and bubble formation in first dielectric layer 81 is considered. It is known that addition of $MoO_3$ or $WO_3$ to a dielectric glass containing $Bi_2O_3$ can easily cause the formation of compounds, at low temperatures of 580° C. or less, such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$. In the embodiment, since the firing temperature of dielectric layer 8 is from 550° C. to 590° C., silver ions ($Ag^+$) diffused into dielectric layer 8 during the firing react with $MoO_3$, $WO_3$, $CeO_2$, and $MnO_2$ in dielectric layer 8 to form stable compounds, thereby being stabilized. That is, since the $Ag^+$ is stabilized without being reduced, it does not undergo agglomeration to form a colloid. Therefore, the stabilization of $Ag^+$ decreases a generation of oxygen associated with the formation of colloidal Ag, which in turn decreases the formation of bubbles in dielectric layer 8.

Meanwhile, in order to facilitate these advantages, content ratios of $MoO_3$, $WO_3$, $CeO_2$, and $MnO_2$ are set preferably to 0.1 wt % or more in the dielectric glass containing $Bi_2O_3$, and more preferably to be in a range from not less than 0.1 wt % to not greater than 7 wt %. Specifically, the content ratios of less than 0.1 wt % results unpreferably in less effect of inhibiting yellowing, while the content ratios exceeding 7 wt % can unpreferably cause coloration of glass.

That is, in PDP 1 according to the embodiment, dielectric layer 8 inhibits yellowing phenomenon and bubble formation in first dielectric layer 81 in contact with bus electrodes 4*b* and 5*b* containing the Ag material, and provides a high light transmittance due to second dielectric layer 82 disposed on first dielectric layer 81. As a result, dielectric layer 8 as a whole makes it possible to provide the PDP which exhibits very rare occurrences of yellowing and bubble formation and has a high transmittance.

Protective layer 9 includes base layer 91 and aggregated particles 92. Base layer 91 includes at least a first metal oxide and a second metal oxide. The first metal oxide and the second metal oxide are two selected from the group consisting of MgO, CaO, SrO, and BaO. Moreover, base layer 91 exhibits at least one peak in X-ray diffraction analysis. The peak lies between a first peak of the first metal oxide in X-ray diffraction analysis and a second peak of the second metal oxide in X-ray diffraction analysis. The first peak and the second peak show the same plane direction as that which the peak of the base layer shows.

Figure 3:
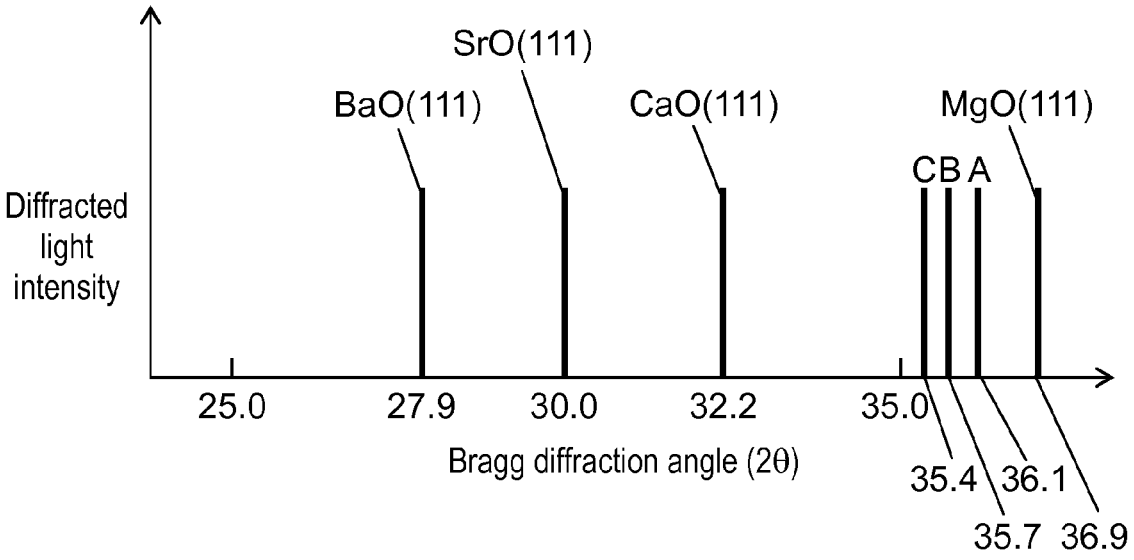
FIG. 3 shows a result of X-ray diffraction analysis on a surface of a base layer of the PDP.

FIG. 3 shows the result of X-ray diffraction analysis of the surface of base layer 91 that configures protective layer 9 of PDP 1 according to the embodiment. Moreover, in FIG. 4, the result of X-ray diffraction analysis of simple substances of MgO, CaO, SrO, and BaO is shown.

In FIG. 3, the horizontal axis represents Bragg diffraction angle (2θ), and the vertical axis represents intensity of diffracted X-ray waves. The diffraction angle is expressed by a unit of degree, e.g. 360 degrees for a full circle, and the intensity is represented by an arbitrary unit. Crystal plane directions, which are specific plane directions, are shown in parentheses.

As shown in FIG. 3, in the (111) plane direction, a simple substance of CaO exhibits a peak at a diffraction angle of 32.2 degrees, a simple substance of MgO exhibits a peak at a diffraction angle of 36.9 degrees, a simple substance of SrO exhibits a peak at a diffraction angle of 30.0 degrees, and a simple substance of MgO exhibits a peak at a diffraction angle of 27.9 degrees.

In PDP 1 according to the embodiment, base layer 91 of protective layer 9 includes at least two metal oxides selected from the group consisting of MgO, CaO, SrO, and BaO.

Figure 7:
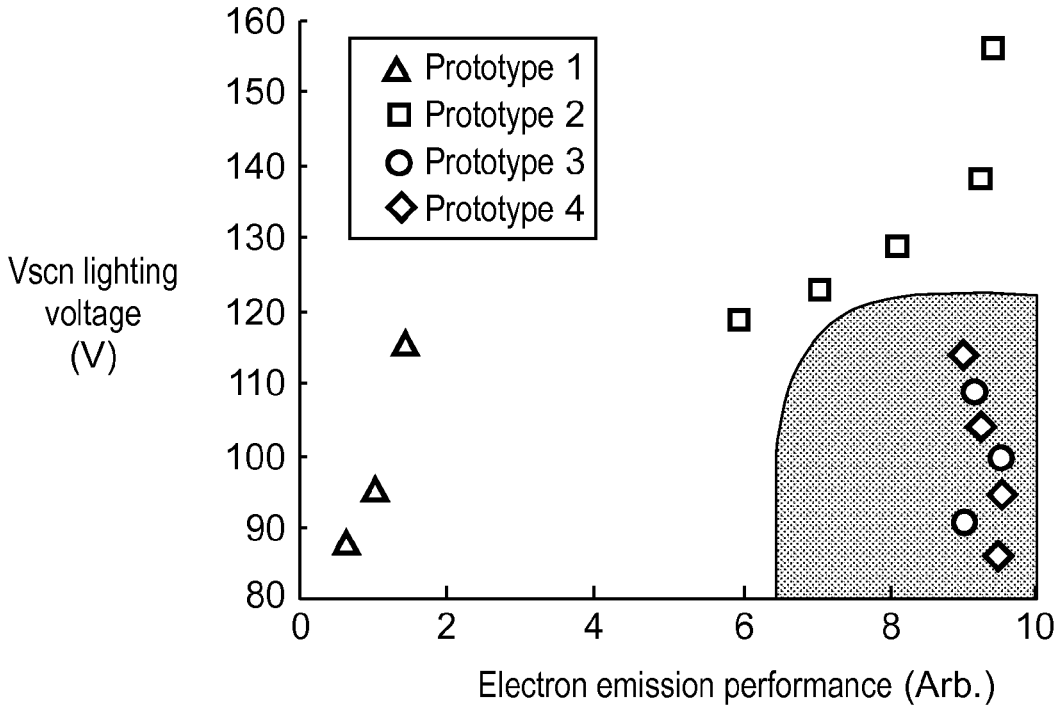
FIG. 7 is a characteristic graph showing the result of an examination of electron emission performance and Vscn lighting voltage of the PDP.

FIG. 7 shows the results of X-ray diffraction analysis of base layer 91 in the case where components configuring the base layer are two simple substances. Point "A" shows the result of X-ray diffraction analysis of base layer 91 formed with simple substance components of MgO and CaO. Point "B" shows the result of X-ray diffraction analysis of base layer 91 formed with simple substance components of MgO and SrO. Point "C" shows the result of X-ray diffraction analysis of base layer 91 formed with simple substance components of MgO and BaO.

As shown in FIG. 3, in the (111) plane direction, point "A" exhibits a peak at a diffraction angle of 36.1 degrees. The simple substance of MgO, i.e. the first metal oxide, exhibits a peak at a diffraction angle of 36.9 degrees. The simple substance of CaO, i.e. the second metal oxide, exhibits a peak at a diffraction angle of 32.2 degrees. That is, the peak of point "A" lies between the peak of simple substance of MgO and the peak of simple substance of CaO. Similarly, the peak of point "B" is at a diffraction angle of 35.7 degrees, which lies between the peak of simple substance of MgO, i.e. the first metal oxide, and the peak of simple substance of SrO, i.e. the second metal oxide. Like this, the peak of point "C" is at a diffraction angle of 35.4 degrees, which lies between the peak of simple substance of MgO, i.e. the first metal oxide, and the peak of simple substance of BaO, i.e. the second metal oxide.

Figure 8:
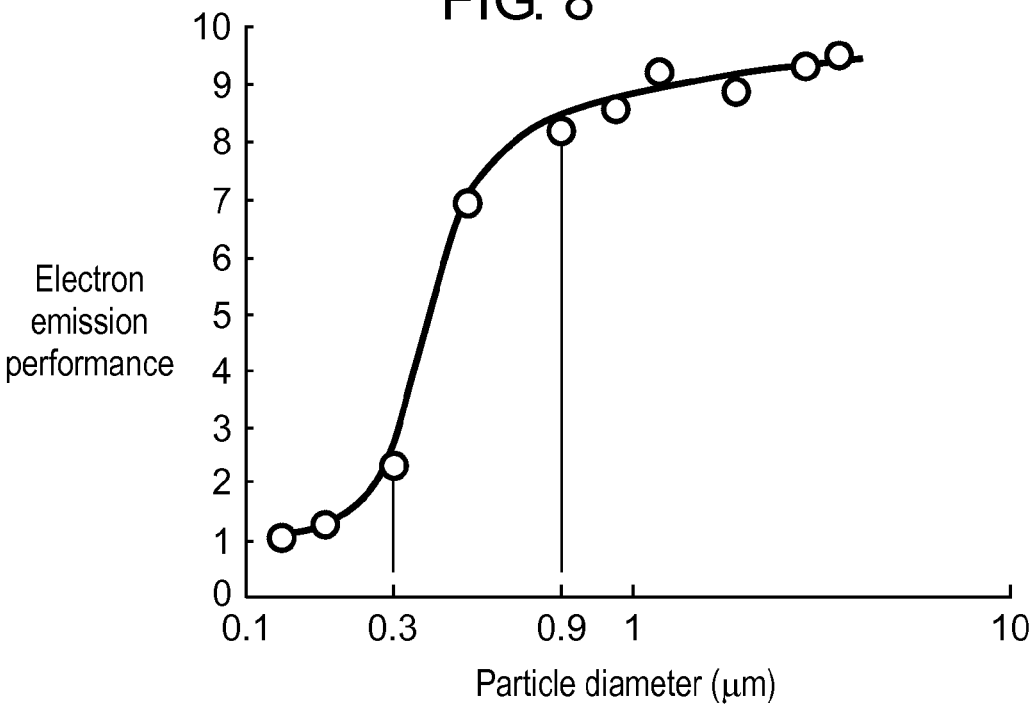
FIG. 8 is a characteristic graph showing a relation between average particle diameters of aggregated particles and electron emission performance according to an embodiment.

FIG. 8 shows the results of X-ray diffraction analysis of base layer 91 in the case where components configuring the base layer are three or more simple substances. Point "D" shows the result of X-ray diffraction analysis of base layer 91 formed with simple substance components of MgO, CaO, and SrO. Point "E" shows the result of X-ray diffraction analysis of base layer 91 formed with simple substance components of MgO, CaO, and BaO. Point "F" shows the result of X-ray diffraction analysis of base layer 91 formed with simple substance components of CaO, SrO, and BaO.

Figure 4:
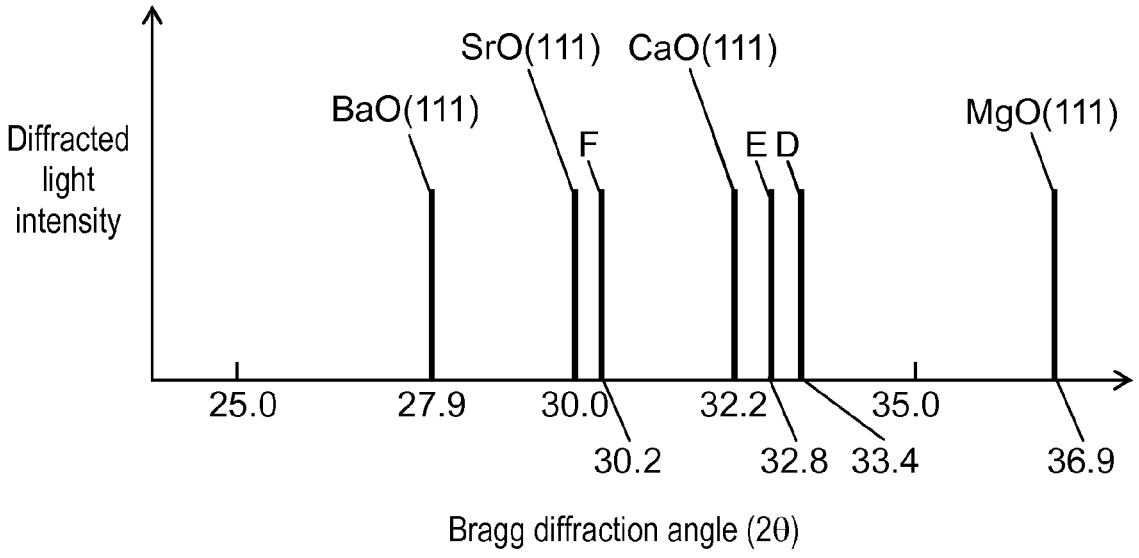
FIG. 4 shows a result of X-ray diffraction analysis on a surface of another base layer with a different configuration of the PDP.

As shown in FIG. 4, in the (111) plane direction, point "D" exhibits a peak at a diffraction angle of 33.4 degrees. The simple substance of MgO, i.e. the first metal oxide, exhibits a peak at a diffraction angle of 36.9 degrees. The simple substance of SrO, i.e. the second metal oxide, exhibits a peak at a diffraction angle of 30.0 degrees. That is, the peak of point "A" lies between the peak of simple substance of MgO and the peak of simple substance of CaO. Similarly, the peak of point "E" is at a diffraction angle of 32.8 degrees, which lies between the peak of simple substance of MgO, i.e. the first metal oxide, and the peak of simple substance of BaO, i.e. the second metal oxide. Like this, the peak of point "F" is at a diffraction angle of 30.2 degrees, which lies between the peak of simple substance of MgO, i.e. the first metal oxide, and the peak of simple substance of BaO, i.e. the second metal oxide.

Hence, base layer 91 of PDP 1 according to the embodiment includes at least the first metal oxide and the second metal oxide. Moreover, base layer 91 has at least one peak in X-ray diffraction analysis thereof. The peak lies between the first peak of the first metal oxide in X-ray diffraction analysis and the second peak of the second metal oxide in X-ray diffraction analysis. The first peak and the second peak show the same plane direction as that which the peak of base layer 91 shows. The first metal oxide and the second metal oxide are two selected from the group consisting of MgO, CaO, SrO, and BaO.

Note that, in the above description, the explanation is made specifically in the case of the (111) crystal plane direction; however, in cases of other crystal plane directions, positions of diffraction peaks of the metal oxides are in the same manner as those described above.

Energy levels of CaO, SrO, and BaO are present in a shallower region in depth below the vacuum level, compared with that of MgO. Therefore, in operating PDP 1, it is thought that when electrons present at the energy levels of CaO, SrO, BaO, and MgO transit to the ground state of a Xe ion, the number of electrons emitted by the Auger effect is larger in the case of CaO, SrO, and BaO than that in the case of MgO.

Moreover, as described above, the peak of base layer 91 according to the embodiment lies between the peak of the first metal oxide and the peak of the second metal oxide. Therefore, it is thought that the energy level of base layer 91 lies between those of simple substances of metal oxides; therefore, the number of electrons emitted by the Auger effect associated with electron transitions thereof is larger in the case of the base layer than that in the case of MgO.

As a result, base layer 91 can exhibit better secondary-electron emission characteristics than the single substance of MgO, thereby allowing a reduction in a discharge sustaining voltage. This makes it possible to reduce the discharge voltage when Xe partial pressure in the discharge gas is increased in order particularly to raise luminance, which results in PDP 1 having high luminance and capable of being driven with a low discharge voltage.

When the Xe partial pressure in the discharge gas is increased from 10% to 15%, the luminance rises by approximately 30%; however, the discharge sustaining voltage adversely rises by approximately 10% in a comparative example of base layer 91 composed of a simple substance of MgO.

In contrast, in the PDP according to the embodiment, it is possible to reduce the discharge sustaining voltage by approximately 10% to 20%, compared with the comparative example. Accordingly, it is possible to set a discharge starting voltage within a range of normal operation, resulting in the PDP having high luminance and capable of being driven with a low voltage.

Note that, because CaO, SrO, and BaO are highly reactive and easy to react with impurities when used as a simple substance, there has been a problem that use of such simple substances can cause a decrease in electron emission performance. However, in the embodiment, these metal oxides are used as compositions thereof so as to reduce their reactivities and to form a crystal structure which undergoes less contamination with impurities and less oxygen deficiency. Therefore, an excessive emission of electrons is thus inhibited during operation of the PDP, thereby advantageously exhibiting appropriate charge-retention characteristics as well as compatibility between low-voltage driving and secondary-electron emission performance. The charge-retention characteristics are effective, in particular, in retaining wall charges accumulated during an initializing period in order to allow a reliable address discharge, which prevents addressing failures.

Next, aggregated particles 92 disposed on base layer 91 in the embodiment will be described in detail.

Aggregated particle 92 is such that a plurality of crystal particles 92*b* aggregate to attach to one crystal particle 92*a* of MgO, where the particle diameter of particles 92*b* is smaller than that of particle 92*a*. The shape of the aggregated particle can be observed under a scanning electron microscope (SEM). In the embodiment, a plurality of aggregated particles 92 are dispersed and disposed on the entire surface of base layer 91.

Crystal particle 92*a* is a particle having an average particle diameter of 0.9 μm to 2 μm; crystal particle 92*b* is a particle having an average particle diameter of 0.3 μm to 0.9 μm. Note that, in the embodiment, the average particle diameters are the cumulative volume average diameters (D50). Measurements of the average particle diameters were made with a laser diffraction particle size analyzer MT-3300 (manufactured by NIKKISO CO., LTD.).

Figure 5:
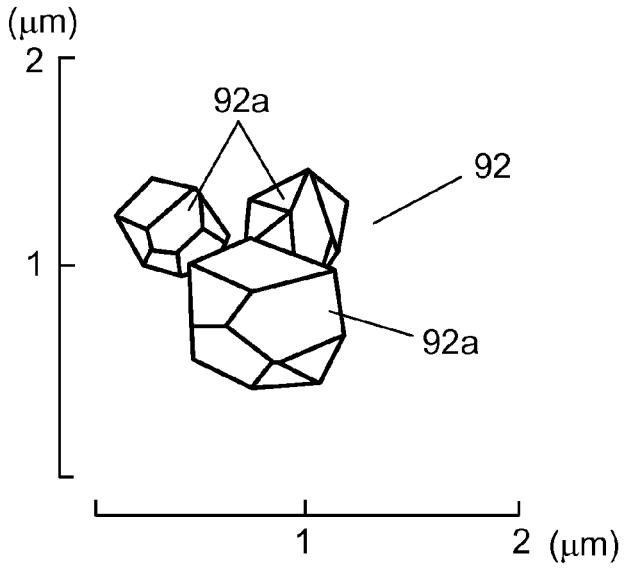
FIG. 5 is a magnified view illustrating aggregated particles according to an embodiment.

As shown in FIG. 5, aggregated particle 92 is a particle in which a plurality of crystal particles 92*a* and 92*b* are aggregated together, which each have a predetermined primary particle diameter. Aggregated particle 92 is not a solid material formed with strong binding forces, but a material such that a plurality of primary particles are aggregated with weak binding forces such as electrostatic forces or van der Waals forces. That is, aggregated particle 92 is formed with so weak binding forces that all or a part thereof can be disaggregated into primary particles by an external force such as ultrasonic waves. The diameter of aggregated particle 92 is approximately 1 μm or so. Crystal particles 92*a* and 92*b* each have a polyhedron shape of seven or more faces, such as truncated octahedron and dodecahedron. Crystal particles 92*a* and 92*b* are produced by a liquid phase method in which a solution of a MgO precursor such as magnesium carbonate and magnesium hydroxide is fired. It is possible to control the particle diameters of the resulting particles by adjusting firing temperature and firing environment of the liquid phase method. The firing temperature may be set in the range from approximately 700° C. to approximately 1500° C. At firing temperatures of 1000° C. or more, diameters of the primary particle can be controlled to be approximately 0.3 μm to 2 μm or so. In the forming process by the liquid phase method, crystal particles 92*a* and 92*b* are produced in a form of aggregated particle 92 where a plurality of the primary particles are mutually aggregated with one another.

According to the experiments conducted by the inventors of the present invention, aggregated particle 92 of MgO has an advantage of inhibiting discharge delay mainly in an address discharge and an advantage of improving a temperature dependence of the discharge delay. Consequently, in the embodiment, aggregated particles 92 are disposed as an initial-electron supplier that is necessary at a rise of a discharge pulse, taking advantages of such excellent characteristics of aggregated particles 92 regarding initial-electron emission, over those of base layer 91.

The discharge delay is considered to be due mainly to a deficiency in the number of initial-electrons serving as a trigger, which are emitted from the surface of base layer 91 into discharge spaces 16 at starting the discharge. For this reason, in order to contribute to a stable supply of initial-electrons to discharge spaces 16, aggregated particles 92 of MgO are dispersed and disposed on the surface of base layer 91. This allows plenty of electrons present in discharge spaces 16 at the rise of the discharge pulse, thereby eliminating the discharge delay. Accordingly, with such initial-electron emission characteristics, PDP 1 is capable of being driven at high speed with a high-speed discharge response, even in high-definition applications. Note that, the configuration, in which aggregated particles 92 of metal oxides are dispersed on the surface of base layer 91, provides an advantage of improving a temperature dependence of the discharge delay as well as the advantage of preventing the discharge delay mainly in an address discharge.

As described above, PDP 1 according to the embodiment is configured including: base layer 91 that provides a compatibility between low-voltage driving and charge-retention characteristics, and aggregated particles 92 of MgO that provides the advantage of preventing the discharge delay. This configuration allows PDP 1 as a whole to be driven at high speed with a low voltage and capable of providing a high-quality image display performance, with lighting failures being inhibited, even in a high-definition PDP application.

Figure 6:
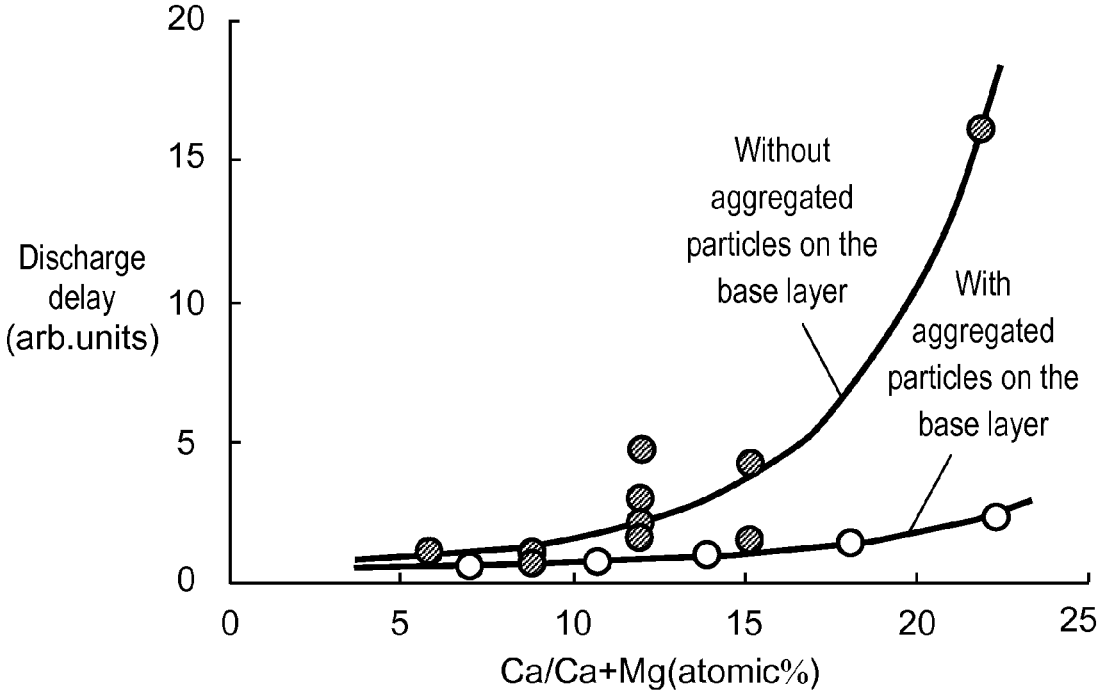
FIG. 6 shows a relation between discharge delay and a concentration of calcium (Ca) in a protective layer of a PDP according to an embodiment.

FIG. 6 shows the relation between discharge delay and a concentration of calcium (Ca) in protective layer 9 in the case where base layer 91 configured with MgO and CaO is used in a PDP, among PDPs1 according to the embodiment. Base layer 91 is configured with MgO and CaO such that base layer 91 exhibits a peak, in X-ray diffraction analysis, at a diffraction angle between diffraction angles at which peaks of MgO and CaO appear.

Note that, FIG. 6 shows two cases: one where protective layer 9 includes base layer 91 only; and the other where protective layer 9 includes base layer 91 and aggregated particles 92 disposed thereon. These discharge delays are shown with the case of base layer 91 without Ca, being used as a standard.

As can be seen from FIG. 6, in comparison between the case of base layer 91 alone and the case of base layer 91 with aggregated particles 92 disposed thereon, the case of base layer 91 alone shows that discharge delays are increased with increasing concentration of Ca. In contrast, the case of base layer 91 with aggregated particles 92 disposed thereon shows that discharge delays are decreased by a large amount and are hard to increase, with increasing concentration of Ca.

Next, the result of the experiments is described which were conducted for confirming the advantages of PDP 1 having protective layer 9 according to the embodiment.

First, prototypes of PDP 1 having protective layers 9 of different configurations were produced. Prototype 1 was PDP 1 in which protective layer 9 was formed only with MgO. Prototype 2 was PDP 1 in which protective layer 9 was formed with MgO doped with impurities including Al and Si. Prototype 3 was PDP 1 in which protective layer 9 was formed with MgO and then only primary particles of crystal particles 92*a* of MgO were dispersed on the layer to adhere thereto.

On the other hand, prototype 4 was PDP 1 according to the embodiment. Prototype 4 was PDP 1 in which, aggregated particles 92 were distributed to adhere onto the entire surface of base layer 91 composed of MgO, where aggregated particle 92 had been made such that crystal particles 92*a* of MgO having comparable particle diameters were aggregated to each other. Protective layer 9 employed sample "A" described previously. That is, protective layer 9 included: base layer 91 composed of MgO and CaO and aggregated particles 92 which were distributed substantially uniformly to adhere onto the entire surface of base layer 91, where aggregated particles 92 had been made such that crystal particles 92*a* were aggregated to each other. Note that, in X-ray diffraction analysis of the surface of base layer 91, base layer 91 exhibited a peak between peaks of a first and a second metal oxide which configured base layer 91. Here, the first metal oxide was MgO, and the second metal oxide was CaO. The peak of MgO is at a diffraction angle of 36.9 degrees; the peak of CaO is at a diffraction angle of 32.2 degrees; and the peak of base layer 91 was set to be at a diffraction angle of 36.1 degrees.

For prototype PDPs 1 each having one of the four protective layers with these respective types of configurations, measurements were made in terms of electron emission performance and charge-retention performance.

Incidentally, the electron emission performance is expressed as a numerical value that shows: the larger the value, the larger the amount of electron emission is. Specifically, the electron emission performance is expressed by the amount of initial-electron emission which is determined from conditions of a surface facing discharge, kinds of discharge gases, and conditions of the gases. The initial-electron emission can be measured by a method that includes: irradiating a surface to be measured with an ion beam or an electron beam, measuring the amount of an electron current emitted from the irradiated surface. However, it is difficult to carry out the measurement as a nondisruptive one. For this reason, the method disclosed in Japanese Patent Unexamined Publication No. 2007-48733 was used. Specifically, among various delay times of discharges, a so-called statistical delay time was measured which serves a rough indication of the ease with which a discharge occurs. Integrating the reciprocal of a value of the statistical delay time yielded a numerical figure linearly corresponding to the amount of initial-electron emission. Here, the discharge delay time is a period of time from a rise of an address discharge pulse until an occurrence of a delayed address discharge. The major cause of the discharge delay time is considered to lie in that it tends to be difficult for the surface of a protective layer to emit initial-electrons into discharge spaces. The initial-electrons serve as a trigger to start the address discharge.

In addition, a voltage applied to scan electrodes (hereinafter referred to as a "Vscn lighting voltage") was used as an index of the charge-retention performance; where the Vscn lighting voltage is a voltage necessary to inhibit charge emission phenomenon of PDP 1 configured with the measured protective layer. Specifically, a lower Vscn lighting voltage indicates a higher charge-retention performance. In other words, when the Vscn lighting voltage is lower, the PDP can be driven by a lower voltage. This means that a power supply unit and other electrical units of the PDP are allowed to advantageously employ electric components of less withstand voltage and less capacitance. In existing products, an element with a withstand voltage of approximately 150 V is used for a semiconductor switching element such as MOSFET for sequentially applying a scan voltage to a panel. The Vscn lighting voltage is preferably restricted to be 120 V or less, taking temperature dependent variations in consideration.

These PDPs 1 were examined in terms of electron emission performance and charge-retention performance, and the results thereof are shown in FIG. 7. Note that, the electron emission performance is expressed as a numerical value that means: the larger the value is, the larger the amount of electron emission is. Specifically, the electron emission performance is expressed by the amount of initial-electron emission which is determined from conditions of a surface concerned, kinds of discharge gases, and conditions of the gases. The initial-electron emission can be measured by a method that includes: irradiating a surface to be measured with an ion beam or an electron beam, measuring the amount of an electron current emitted from the irradiated surface. However, it can entail a difficulty to carry out a nondisruptive examination of the surface of front plate 2 of PDP 1. Hence, the method disclosed in Japanese Patent Unexamined Publication No. 2007-48733 was used. Specifically, among various delay times of discharge, a so-called statistical delay time was measured which serves as a rough indication of the ease with which a discharge occurs. Integrating the reciprocal of the measured value yielded a numerical figure that linearly corresponded to the amount of initial-electron emission.

Then the resulting numerical figure was used for the evaluation. Incidentally, the discharge delay time is a period of time, from a rise of an address discharge pulse till an occurrence of the delayed address discharge. The major cause of the discharge delay time is considered to lie in that it tends to be difficult for the surface of protective layer 9 to emit initial-electrons into a discharge space. The initial-electrons serve as a trigger to start the address discharge.

To evaluate the charge-retention performance, the Vscn lighting voltage applied to scan electrodes was used as an index thereof', where the Vscn lighting voltage is a voltage necessary to inhibit charge emission phenomenon of PDP 1 configured with the measured protective layer. This means that the lower the Vscn lighting voltage is, the higher the charge-retention performance is. The lower Vscn lighting voltage allows PDP 1 to be designed such that electric components of less withstand voltage and less capacitance are advantageously used for a power supply unit and other electrical units of the PDP. In existing PDP products, an element with a withstand voltage of approximately 150 V is used for a semiconductor switching element such as MOSFET used for sequentially applying a scan voltage to a panel. Therefore, the Vscn lighting voltage is preferably restricted to be 120 V or less, taking temperature-dependent variations into consideration.

As can be seen from FIG. 7, prototype 4 successfully showed a Vscn lighting voltage of 120 V or less in the evaluation for charge-retention performance, and showed a remarkably excellent characteristic in electron emission performance compared with those of prototype 1 composed only of the protective layer of MgO.

In general, electron emission capability and charge-retention capability of a protective layer of a PDP are in reciprocal relation. For example, it is possible to improve the electron emission performance by changing film-forming conditions of the protective layer or by forming the protective layer with doped impurities such as Al, Si, and Ba thereinto. Unfortunately, it entails an adverse effect, i.e. an increase in the Vscn lighting voltage.

In contrast, in a PDP having protective layer 9 according to the embodiment, it is possible to achieve the electron emission capability of eight or more in a scale of electron emission performance and the charge-retention capability of exhibiting a Vscn lighting voltage of 120 V or less. In other words, it is possible to obtain protective layer 9 with such both capabilities, i.e. electron emission and charge-retention capabilities, that protective layer 9 is applicable to PDPs having a tendency to employ the increased number of scan lines and cells decreased in size, for high definition applications.

Next, particle diameters of crystal particles used in protective layer 9 of PDP 1 according to the embodiment are described in detail. Note that, in the following description, the particle diameters are the average particle diameters which mean the cumulative volume average diameters (D50).

FIG. 8 shows the experimental result of examining protective layer 9 for electron emission performance by modifying the average particle diameters of aggregated particles 92 of MgO. In FIG. 8, the average particle diameters of aggregated particles 92 were measured by observing the diameters thereof with a SEM.

As shown in FIG. 8, the small average particle diameters of 0.3 lam or so provide a low electron emission performance, while the larger average particle diameters of approximately 0.9 μm or more provide a high electron emission performance.

A larger number of crystal particles per unit area on protective layer 9 is preferable for increasing the number of emitted electrons. According to the experiments conducted by the inventors of the present invention, there is the case where the particles cause the tops of barrier ribs 14 to break when crystal particles 92*a* and 92*b* are present on the protective layer's portions corresponding to the tops of barrier ribs 14 with which protective layer 9 is in close contact. In this case, a phenomenon was found in which corresponding cells are not normally lit or unlit, because of the presence of material pieces of broken barrier ribs 14 on phosphors and the like. Since the phenomenon of barrier rib breakage is hard to occur in cases of the absence of crystal particles 92*a* and 92*b* on the portions corresponding to the tops of barrier ribs 14, it can be said that the larger the number of crystal particles adhering to the protective layer is, the greater the breakage-occurrence probability of barrier ribs 14 is. From the above viewpoint, with increased crystal diameters up to 2.5 μm or so, the probability of barrier rib breakage rises rapidly; with small crystal diameters of less than 2.5 μm, the probability of barrier rib breakage can be restricted to be relatively small.

As described above, in PDP 1 having protective layer 9 according to the embodiment, it is possible to achieve the electron emission capability of eight or more in a scale of electron emission performance and the charge-retention capability exhibiting a Vscn lighting voltage of 120 V or less.

It should be noted that, in the embodiment, crystal particles have been explained using MgO particles, but the kind of crystal particles is not limited to MgO because use of even other particles can provide equivalent advantages, which are composed of metal oxides of metals such as Sr, Ca, Ba, and Al and have a high electron emission performance as well as MgO.

Next, referring to FIG. 9, a manufacturing process of forming protective layer 9 in PDP 1 according to the embodiment will be described.

Figure 9:
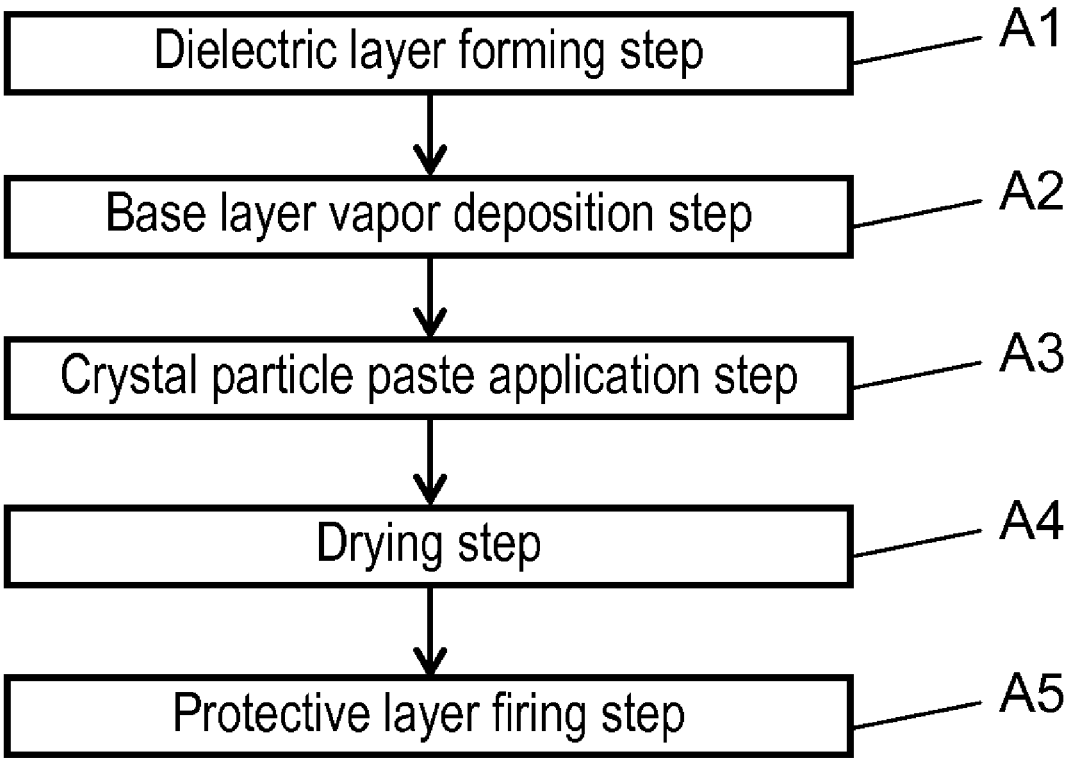
FIG. 9 is a process flowchart illustrating formation of a protective layer according to an embodiment.

As shown in FIG. 9, after performing step A1 of dielectric layer formation of dielectric layer 8, base layer 91 composed of MgO with an impurity of Al is formed on dielectric layer 8 by vacuum vapor deposition using a raw material of sintered bodies of MgO containing Al, in step A2 of base layer vapor deposition.

After that, a plurality of aggregated particles 92 are discretely dispersed on unfired base layer 91 to adhere thereto. That is, aggregated particles 92 are dispersed and disposed on the entire surface of base layer 91.

In this process, an aggregated-particle paste is first prepared by mixing, into a solvent, crystal particles 92*a* and 92*b* having a polyhedron shape and a predetermined particle size distribution. Then, in step A3 of aggregated-particle paste application, the aggregated-particle paste is applied on base layer 91 to form a film of the aggregated-particle paste, with an average thickness of the film of 8 μm to 20 μm. Note that, as a method for applying the aggregated-particle paste on base layer 91, screen printing, spraying, spin coating, die coating, slit coating, or the like may be used.

Here, the solvent suitably used in preparing the aggregated-particle paste is preferably such that: the solvent has a high affinity for base layer 91 of MgO and aggregated particles 92; a vapor pressure of the solvent is several tens Pa or so at room temperature, for easy evaporation-removal thereof in the subsequent step, i.e. drying step A4. For example, the solvent includes: a single organic solvent including such as methyl-methoxybutanol, terpineol, propylene glycol, or benzyl alcohol; and a mixed solvent thereof. A paste containing the solvent has a viscosity of several mPa·s to several tens mPa·s.

Immediately after applying the aggregated-particle paste to the substrate, the substrate is set to undergo drying step A4. In drying step A4, the film of the aggregated-particle paste is dried under reduced pressure. Specifically, the film of the aggregated-particle paste is rapidly dried in a vacuum chamber within several tens seconds. Therefore, no convection flow occurs in the film, which predominantly occurs when dried by heating. This allows aggregated particles 92 to adhere more uniformly onto base layer 91. Note that, as a drying method in drying step A4, a drying-by-heating method may be used depending on conditions including solvents used in preparing the mixed-crystal-particle paste.

Next, in step A5 of protective layer firing, both unfired base layer 91 formed in step A2 of base layer vapor deposition and the film of the aggregated-particle paste after drying step A4 are simultaneously fired at a temperature of several hundred degrees Celsius. By the firing, the solvents and resin components remaining in the film of the aggregated-particle paste are removed. Thus, protective layer 9 is formed such that aggregated particles 92 adhere onto base layer 91 and aggregated particles 92 are composed of a plurality of crystal particles 92*a* and 92*b* having a polyhedron shape.

According to the method, it is possible to disperse and dispose aggregated particles 92 on the entire surface of base layer 91.

Note that, instead of the method described above, other methods without use of solvents may be employed, including: directly spraying particle-assemblages together with a gas or the like, and dispersing particle-assemblages simply by means of gravity.

It should be noted that, in the aforementioned description, MgO has been exemplified for protective layer 9; however, base layer 91 is required only to have a high sputter-resistance performance for protecting dielectric layer 8 from ion bombardment, but not required to have such a high charge-retention capability, i.e. a high election emission capability attributed to MgO. In conventional PDPs, protective layers have been very commonly formed with MgO as a primary component in order to achieve compatibility between electron emission performance above a level and sputter-resistance performance. In contrast, the protective layer of the embodiment need not be composed of MgO, but rather may be composed of other materials excellent in bombardment-resistance such as $Al_2O_3$, because of the configuration thereof in which electron emission performance is controlled dominantly by the metal-oxide single-crystal particles.

Moreover, in the embodiment, single crystal particles have been explained using MgO particles, but the kind of particles is not limited to MgO. This is because other single crystal particles can be used to provide equivalent advantages, which are composed of oxides of metals including Sr, Ca, Ba, and Al and have a high electron emission performance as well as MgO.

Figure 11:
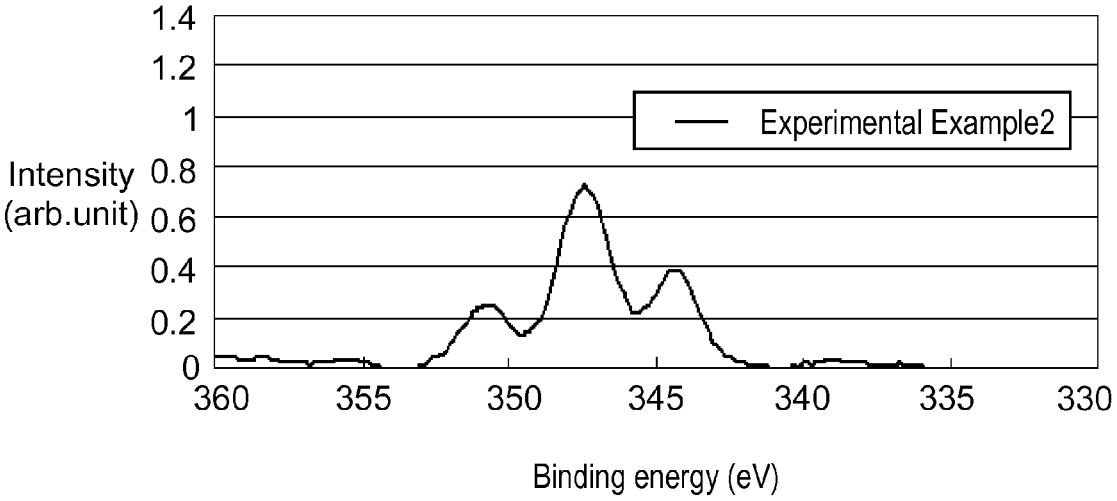
FIG. 11 shows a biding energy spectrum by X-ray photoemission spectroscopy of a protective layer of a PDP according to a second embodiment.
Figure 12:
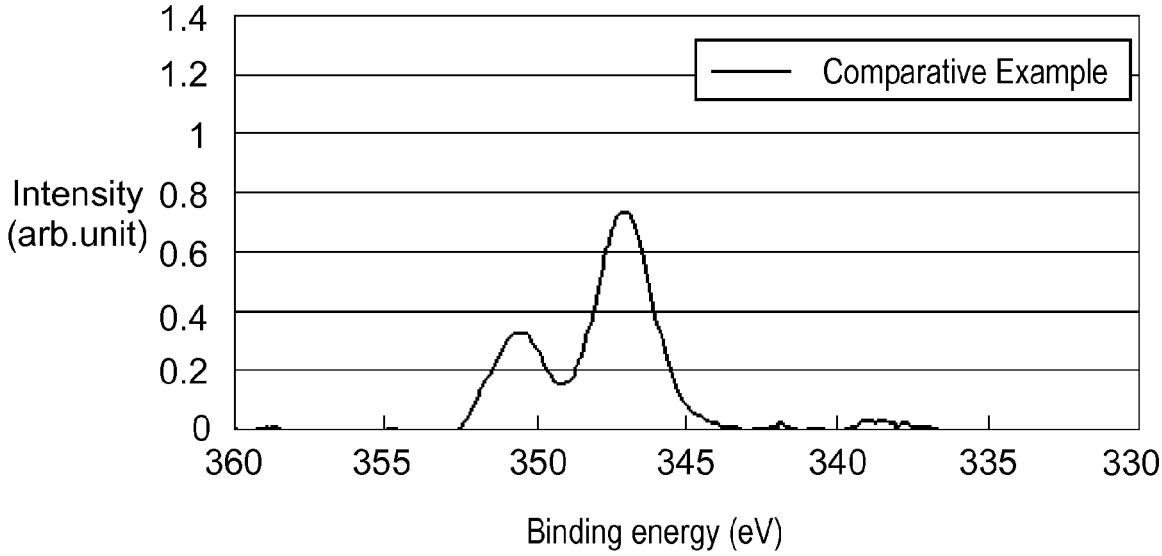
FIG. 12 shows a biding energy spectrum profile by X-ray photoemission spectroscopy of a protective layer of a PDP of a comparative example.

Next, details of protective layer 9 according to the embodiment are described with reference to FIGS. 10, 11, and 12. Protective layer 9 includes magnesium oxide (MgO) and calcium oxide (CaO). In general, X-ray photoemission spectroscopy is used to know electronic states in constituent elements of a sample. That is, by X-ray photoemission spectroscopy, analysis of protective layer 9 of the embodiment in terms of binding energy of electrons shows electronic states in calcium (Ca) and magnesium (Mg).

Protective layer 9 according to the embodiment, when contains calcium oxide (CaO), was found to exhibit characteristic peaks in the result of analysis by X-ray photoemission spectroscopy. Since a calcium (Ca) atom has 2p-orbital electrons with binding energies in a range from 340 eV to 355 eV, the bonding state of the calcium (Ca) atom can be determined from electron binding energies in this range.

Here, peaks in X-ray photoemission spectroscopy are defined by the following procedures: obtaining a binding energy spectrum ranging from not less than 340 eV to not greater than 355 eV; removing background components from the obtained spectrum; determining positions in the resultant spectrum, at which the spectrum intensity is 10% or more of the maximum intensity of the spectrum and the differential value of the spectrum is zero; and defining the determined positions as the peaks. Note that protective layers 9 measured by X-ray photoemission spectroscopy were protective layers 9 of PDPs in Experimental Example 1 and Experimental Example 2 to be described below. The result of protective layers 9 in the PDP in Experimental Example 1 is shown in FIG. 10, and the result of protective layers 9 in the PDP in Experimental Example 2 is shown in FIG. 11. Note also that, FIG. 12 shows the measurement result of peaks, by X-ray photoemission spectroscopy, of the protective layer of the PDP in a Comparative Example.

Based on these results, it is possible to compare Experimental Example 1 and Experimental Example 2 with the Comparative Example.

Experimental Example 1

Protective layer 9 was formed with a thickness of 800 nm by deposition using an electron beam to evaporate an evaporation source, i.e. a mixed powder of MgO powder and CaO powder, in ratio by weight of 9:1. During the film formation, oxygen was introduced at 100 sccm into the evaporation chamber, and the pressure of the evaporation chamber was 0.04 Pa. The temperature of the substrate was 300° C. during the film formation. The front plate and the rear plate were sealed together with frit glass, and a mixed gas of 90% of Ne and 10% of Xe was enclosed in internal discharge spaces therebetween at a pressure of 50 kPa, thereby completing a PDP. The binding energy spectrum for the protective layer had three peaks in the range from not less than 340 eV to not greater than 355 eV. The binding energy spectrum was made with an X-ray photoelectron spectroscopy analyzer (JPS-9010, manufactured by JEOL Ltd.). The X-ray source was magnesium (Mg), the acceleration voltage was 10 kV, and the emission current was 20 mA.

FIG. 10 shows the binding energy spectrum.

In Experimental Example 1, protective layer 9 of the PDP according to the embodiment showed the binding energy spectrum that had three peaks in the range from not less than 340 eV to not greater than 355 eV.

Experimental Example 2

A PDP was produced, and protective layer 9 of which showed a binding energy spectrum having three peaks in the range from not less than 340 eV to not greater than 355 eV. The PDP was produced in the same manner as in Experimental Example 1; however, the obtained binding energy spectrum was different from that in Experimental Example 1. The binding energy spectrum in Experimental Example 2 is shown in FIG. 11.

Comparative Example

A PDP was produced, and protective layer 9 of which showed a binding energy spectrum having two peaks in the range from not less than 340 eV to not greater than 355 eV. The binding energy spectrum is shown in FIG. 12.

The PDPs produced in aforementioned Experimental Example 1, Experimental Example 2, and the Comparative Example were measured in terms of discharge sustaining voltage by applying a voltage of rectangular waves of 100 kHz. The measurement result is shown in Table 1.

TABLE 1

| | Discharge sustaining voltage |
|---|---|
| Experimental Example 1 | 185 V |
| Experimental Example 2 | 190 V |
| Comparative Example | 210 V |

In the analysis of binding energies by X-ray photoemission spectroscopy, the PDP of Experimental Example 1, in which the binding energy spectrum had the three peaks in the range from not less than 340 eV to not greater than 355 eV, exhibited a discharge sustaining voltage of 185 V. The PDP of Experimental Example 2, with the three peaks in the same manner as in Experimental Example 1, exhibited a discharge sustaining voltage of 190 V. On the other hand, the PDP of the Comparative Example, with the two peaks in the range from not less than 340 eV to not greater than 355 eV, exhibited a discharge sustaining voltage of 210 V.

Consequently, in the analysis of binding energies by X-ray photoemission spectroscopy, it was found that the PDPs having protective films 9 each exhibiting the three peaks of the binding energy spectrum thereof in the range from not less than 340 eV to not greater than 355 eV were reduced in their discharge sustaining voltages, compared with the PDP having protective film 9 exhibiting the two peaks.

INDUSTRIAL APPLICABILITY

As described above, the present invention is useful for realizing a PDP that features display performance of high resolution and high luminance and offers low power consumption.

REFERENCE MARKS IN THE DRAWINGS

| | |
|---|---|
| 1 | PDP |
| 2 | front plate |
| 3 | front glass substrate |
| 4 | scan electrode |
| 4a, 5a | transparent electrode |
| 4b, 5b | bus electrode |
| 5 | sustain electrode |
| 6 | display electrode |
| 7 | black stripe |
| 8 | dielectric layer |
| 9 | protective layer |
| 10 | rear plate |
| 11 | rear glass substrate |
| 12 | data electrode |
| 13 | underlying dielectric layer |
| 14 | barrier rib |
| 15 | phosphor layer |
| 16 | discharge space |
| 17 | phosphor particle |
| 18 | platinum-group-element particle |
| 19 | phosphor paste |
| 81 | first dielectric layer |
| 82 | second dielectric layer |
| 91 | base layer |
| 92 | aggregated particle |
| 92a, 92b | crystal particle |

The invention claimed is:

1. A plasma display panel comprising:

a front plate including a dielectric layer and a protective layer covering the dielectric layer;

a rear plate disposed opposite to the front plate, the rear plate including an underlying dielectric layer and a plurality of barrier ribs disposed on the underlying dielectric layer; and phosphor layers disposed on the underlying dielectric layer and on side surfaces of the barrier ribs, wherein the protective layer includes protective layer magnesium oxide and calcium oxide, and exhibits three peaks in a range from not less than 340 eV to not greater than 355 eV of a binding energy spectrum in a binding energy analysis of the protective layer by X-ray photoemission spectroscopy.

* * * * *